US006081105A

United States Patent [19]

Nair

[11] Patent Number: 6,081,105

[45] **Date of Patent: *Jun. 27, 2000**

[54] MULTI-MODE LOW POWER VOLTAGE REGULATOR

[75] Inventor: Raj Nair, Chandler, Ariz.

[73] Assignee: Intel Corporation, Santa Clara, Calif.

[ * ] Notice: This patent is subject to a terminal disclaimer.

[21] Appl. No.: 09/264,349

[22] Filed: Mar. 8, 1999

Related U.S. Application Data

[63] Continuation of application No. 08/940,083, Sep. 29, 1997, Pat. No. 5,955,870.

[51] Int. Cl.[7] ..... G05F 1/575

[52] U.S. Cl. ..... 323/273; 323/280

[58] Field of Search ..... 323/266, 272, 323/273, 313; 307/66

[56] References Cited

U.S. PATENT DOCUMENTS

| | | | |
|---|---|---|---|
| 4,074,182 | 2/1978 | Weischedel | 323/269 |
| 4,298,835 | 11/1981 | Rowe . | |
| 4,731,574 | 3/1988 | Melbert . | |
| 4,860,185 | 8/1989 | Brewer et al. | 363/41 |
| 5,563,501 | 10/1996 | Chan . | |
| 5,570,004 | 10/1996 | Shibata . | |
| 5,686,821 | 11/1997 | Brokaw . | |
| 5,757,170 | 5/1998 | Pinney | 323/266 |

*Primary Examiner*—Adolf Deneke Berhane
*Attorney, Agent, or Firm*—Blakely, Sokoloff, Taylor & Zafman LLP

[57] ABSTRACT

A voltage regulator that has a first mode circuit having a gating device and an amplifier, the gating device with a first input for receiving a first voltage, a second input, and an output. The amplifier is configured to receive a reference voltage and the gating device output as the second input. The gating device is configured to receive an amplifier output at said second input and responsive thereto to couple the first voltage with the gating device output when the gating device output is within a voltage range. The voltage regulator also has a second mode circuit having a voltage divider with an output. The voltage divider is configured to received the first voltage and supply a second voltage to the voltage divider output. The invention also relates to an integrated circuit having a power bus line and at least two voltage regulator cells coupled to the power bus line.

4 Claims, 3 Drawing Sheets

MULTI-MODE LOW POWER VOLTAGE REGULATOR

This application is a continuation of U.S. application Ser. No. 08/940,083 filed Sep. 29, 1997 now U.S. Pat. No. 5,955,870.

BACKGROUND OF THE INVENTION

1. Field of the Invention

The invention relates to integrated circuit devices and more particularly to voltage regulation on such devices.

2. Description of Related Art

Modern integrated circuits are designed for very low power operation. The use of complementary metal oxide semiconductor (CMOS) devices, which have low static power consumption, has allowed this low power operation. The use of CMOS structures facilitates further reduction in power as integrated circuits move from an operational standard of 5 volts to operate at 3.3 volts.

As a consequence of designing circuit chips to operate at a lower supply voltage (e.g., 3.3 volts), chip manufacturers have had to accommodate the requirements of, for example, chip users, such as computer manufacturers and others, that have designed their devices to operate at a higher supply voltage (e.g., 5 volts). Thus, in lower voltage chips, the supply voltage must be regulated.

In the past, regulation has been achieved by external regulators added to systems, such as computers or other equipment, that regulate the voltage down to the required supply voltage for the chip for an active or operational mode.

In addition to the active or operational mode, most CMOS chips are expected to be able to go into a passive or power-down mode of operation. The power-down mode conserves power and is very useful in portable systems. In the power-down mode, the integrated circuits of a chip are expected to retain some information, for example, a memory of the status of particular circuits.

In the power-down mode, there is generally minimal or no current flow. Nevertheless, the power-down mode requires that the supply voltage in which the chip is operating must stay at the required supply voltage, e.g., 5 volts cr 3.3 volts, to retain information. The power-down mode is a static mode of operation as explained herein using a CMOS structure, an inverter, as an example. An inverter consumes power when switching states. Thus, a low to high signal to an inverter, for example, 0 volts to 3.3 volts, causes the inverter to generate an opposite output, i.e., high to low, e.g., 3.3 volts to 0 volts. This is called inverter switching; the inverter switches from one state to another state. Inverter switching consumes power, i.e., to switch states consumes power. When an inverter is maintained at a steady state, i.e., a non-switching state, for example, low, the inverter output maintains its state at high. In this scenario, the inverter does not consume any power whatsoever. The inverter still must have a supply voltage, e.g., 3.3 volts, to maintain the static state. Thus, in static states, CMOS circuits consume virtually no power. In a dynamic state, a circuit will consume power, for example, to change in mode from high to low. The static state is what is entered into in the passive or power-down mode.

Additionally, the flexibility of a "bypass" mode of operation is desirable in systems transitioning from one operating voltage to another. In this mode, the input power supply voltage is transmitted directly to the output of the regulator, effectively bypassing the regulator's functionality.

No implementation of CMOS on-chip regulators incorporating the above-mentioned modes of operation has been contemplated by prior art circuitry.

SUMMARY OF THE INVENTION

The invention relates to a voltage regulator. The voltage regulator has a first mode circuit having a gating device and an amplifier, the gating device with a first input for receiving a first voltage, a second input, and an output. The amplifier is configured to receive a reference voltage and the gating device output. The gating device is configured to receive an amplifier output at the second input and responsive thereto to couple the first voltage with the gating device output when the gating device output is within a voltage range. The voltage regulator also has a second mode circuit having a voltage divider with an output. The voltage divider is configured to received the first voltage and supply a second voltage to the voltage divider output. In a further aspect, the invention also relates to an integrated circuit having a power bus line and at least two voltage regulator cells coupled to the power bus line.

Additional features and benefits of the invention will become apparent from the detailed description, figures, and claims set forth below.

DETAILED DESCRIPTION OF THE INVENTION

In the following description, numerous specific details are set forth to provide a thorough understanding of the invention. However, one having ordinary skill in the art should recognize that the invention can be practiced without these specific details. In some instances, well-known circuits, structures, and techniques have not been shown in detail to avoid unnecessarily obscuring the invention.

One embodiment of the invention relates to a multi-mode regulator. In this embodiment, the multi-mode voltage regulator serves to derive a lower voltage from a higher voltage input with the ability to maintain the lower voltage value accurately in the presence of large static as well as dynamic load currents. The multi-mode regulator accomplishes this purpose with an active mode for regulation function under load, a power-down mode with passive regulation for maintaining the output voltage at low load, and a bypass mode for nullifying the regulation function.

The multi-mode regulator includes an active mode for dynamic operation, a passive mode or power-down mode for static operation, and a bypass mode. In the embodiment described below, the passive mode overlaps the active mode because the two modes are wired together. The passive mode is made up of a low power, high impedance, voltage divider network that does not interfere with the functionality of the active mode because of its high impedance. The multi-mode regulator also has a bypass mode for systems that utilize a supply voltage in accordance with the voltage requirements of the chip. In the embodiment described below, when the regulator is in the bypass mode, the active mode and the passive mode are disabled. One way this is accomplished is by switching the power supply to the active mode circuit and the passive mode circuit to ground which serves also to turn "on" a device that bypasses normal regulation.

Figure 1:
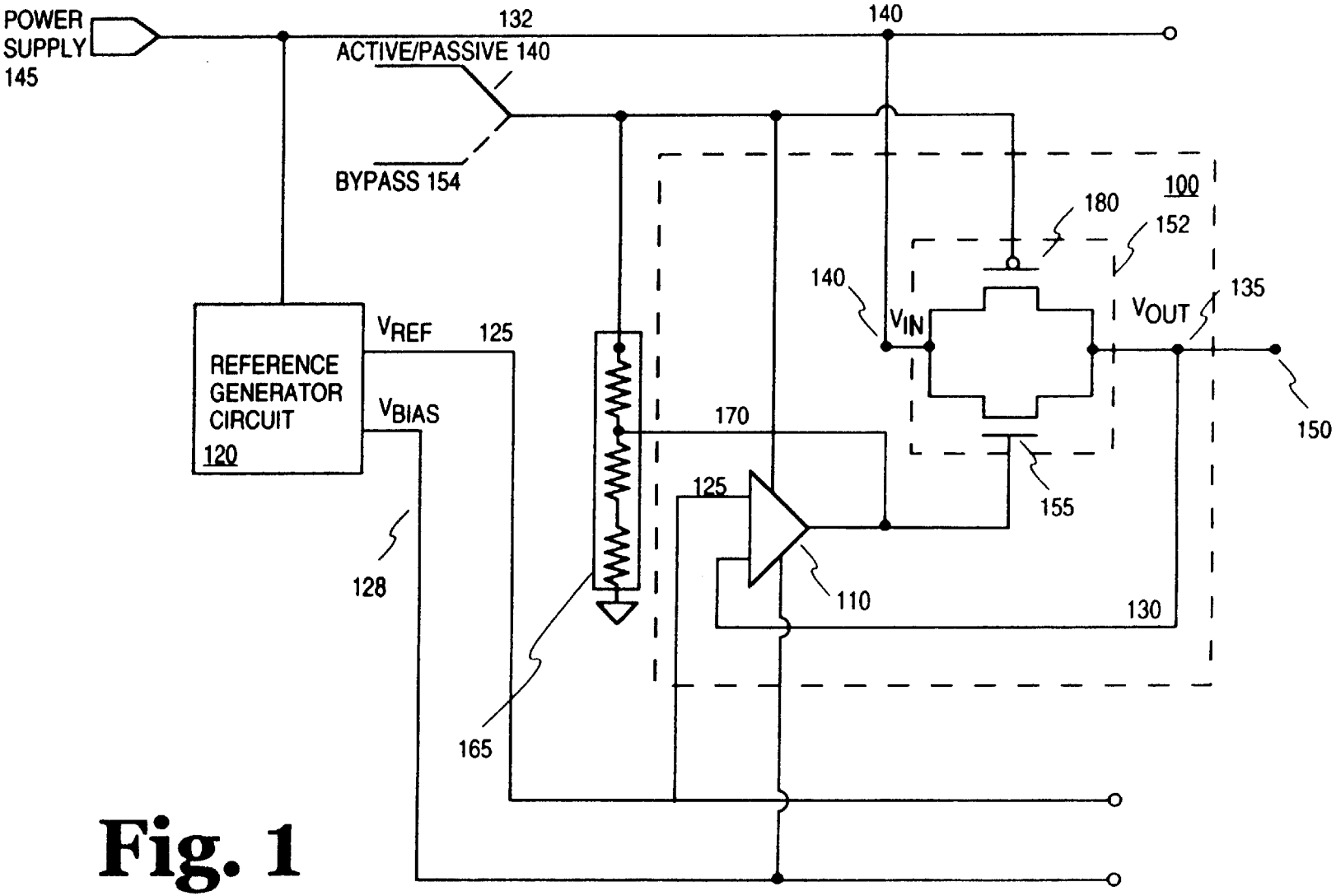
FIG. 1 illustrates one embodiment of a block diagram of a multi-mode voltage regulator cell in accordance with the invention.

FIG. 1 illustrates a block diagram of a multi-mode regulator configured on an integrated circuit chip in accordance with the invention. FIG. 1 shows a switched power supply 145 coupled to a power bus 132. The power bus 132 supplies an input voltage 140 to a series pass device 155. Series pass device 155 has an output, denoted as voltage output 135, that leads to load circuits 150 on the integrated circuit chip. Output 135 of the pass devices 152 is coupled to an input of amplifier 110. Also coupled to amplifier 110 input is a reference voltage 125 generated by a reference voltage generator 120 that is commonly present on the integrated circuit chip.

In an active mode, amplifier 110 compares the output 135 of serves pass device 155 with reference voltage 125. If output voltage 135 is less than or greater than reference voltage 125, amplifier 110 will drive series pass device 155 accordingly. For a power supply that supplies 5 volts to power bus 132 and as input 140 to gating device 152, amplifier 110 will compare output 135 of the gating device 152 to reference voltage 125. For an integrated circuit designed to operate at 3.3 volts, amplifier 110 will receive a reference voltage 125 of 3.3 volts. Amplifier 110 will drive series pass device 155 to maintain a voltage to integrated circuit 150 of 3.3 volts. This is demonstrated by the following example.

CMOS circuits consume power from power supply to ground. Voltage output 135 of series pass device 155 is an output to a large capacitive node, capable of storing charge. When a load 150 on the power supply network or integrated circuit functions, it dissipates charge unidirectionally. Thus, if the output 135 voltage is 3.3 volts, a load on integrated circuit 150 will maintain the voltage below 3.3 volts by consuming power, i.e., load dissipates charge away by the relation $Q=\int_o^T idt$.

The active mode works like a charge pulsing circuit that feeds charge on a capacitive node for an internal power supply. As the capacitive load voltage drops below the required voltage for the circuit, e.g., 3.3 volts, amplifier 110 drives series pass device 155 to supply the requisite voltage. Amplifier 110 serves to maintain the requisite supply voltage to the integrated circuit or power supply network measured at output node 135 at 3.3 volts.

In one embodiment, the active mode is a linear regulator with a series pass N-field effect transistor (FET) 155 driven by a differential error amplifier 110 that compares voltage output 135 at the source of the NFET series pass device 155 with an input reference voltage 125. Differential amplifier 110 has a current source that is powered by another reference input voltage, $V_{BIAS}$, 128.

In the same embodiment, the passive or power-down mode overlaps the active mode because the passive mode circuitry is wired integrally with the active mode circuitry. In the passive mode, the active mode circuitry is de-energized and ceases all control of the output while the passive mode circuitry maintains the output voltage. In the passive mode, amplifier 110 is disabled and drive point 140 connects with the passive mode circuitry. The passive mode circuitry includes a low power, high impedance voltage divider network 165. Voltage divider network 165 does not interfere with the functionality of amplifier 110 during the active mode, because voltage divider network 165 is a high impedance chain (illustrated as a series of resistors). Voltage divider network 165 receives power supply voltage 140 over power bus 132 and steps power supply voltage 140 down to a desired voltage 170 that generates the requisite voltage 135 for integrated circuit chip operation. In one example, input voltage 140 is 5 volts and voltage divider network 165 steps the voltage down to a desired 3.3 voltage for passive mode operation of a 3.3 volt chip. Output voltage 170 of voltage divider network 165 is supplied to gating device 152. In the example where series pass device 152 includes a series pass NFET 155, output voltage 170 of voltage divider network 165 is supplied to NFET device 155 to maintain the voltage at the desired level for passive mode operation.

In the embodiment shown in FIG. 1, gating device 152 is configured to operate in a bypass mode such that, when desired, the supply voltage 140 from the power supply can be supplied directly to integrated circuits 150 of a chip. This would be the case when the integrated circuit or power supply network is configured to operate at the supply voltage. In one embodiment, gating device 152 has a PFET 180 in parallel with series pass NFET 155 controlled by voltage 140 which is the same as the voltage fed to the voltage divider network in passive mode operation and the differential amplifier in active mode operation. PFET 180 serves to completely bypass the active and passive mode regulation circuitry to nullify the regulation function and disconnect all power to the active and passive mode circuitry of the regulator. One way of disconnecting all power to the active mode and passive mode circuitry of the regulator is by a switch 154 on a printed circuit board, such as a conventional manual systems switch 154 that can be open or closed, depending on the operation, by a system user or builder. For example, if a computer manufacturer is using an integrated circuit chip designed to be powered by a 3.3 volt power supply and that computer maker utilizes a 3.3 volt power supply, the computer maker will switch, for example a switch device 154 on printed circuit board to operate in bypass mode and de-energize the active and passive regulation circuits and bypass the regulation function of the regulator.

Figure 2:
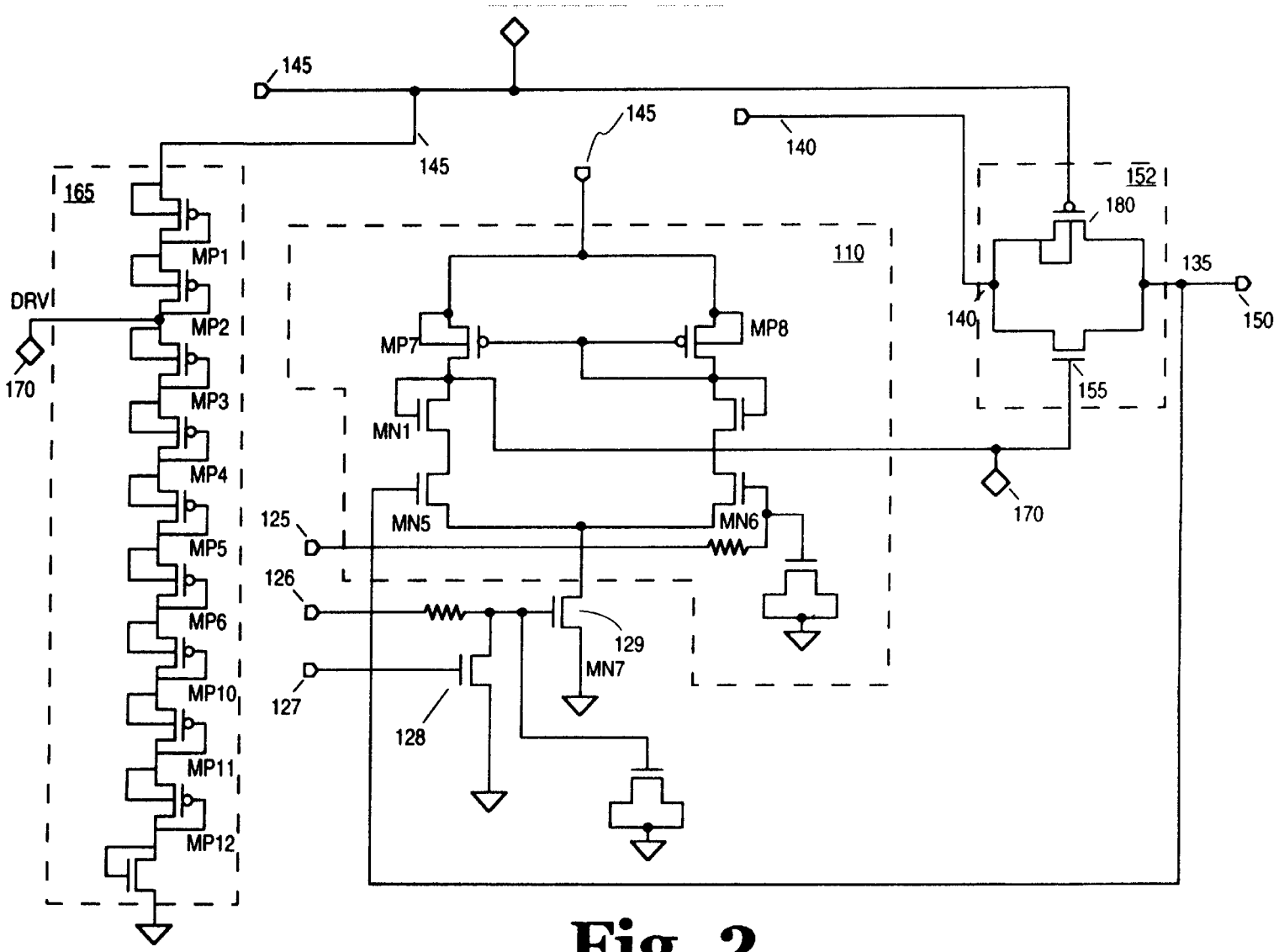
FIG. 2 illustrates one embodiment of multi-mode voltage regulator cell in accordance with the invention.

FIG. 2 shows a detailed schematic illustration of one embodiment of the voltage regulator device of the invention. FIG. 2 shows an active mode circuitry including a series pass NFET 155 driven by a differential amplifier 110 that compares output 135 at the source of NFET device 155 with an input reference signal 125. Differential amplifier 110 has a current source that is powered by another input reference voltage 126.

Differential amplifier 110 is disabled by NFET device 128 during passive mode operation. In this embodiment, signal 127 turns "on" NFET 128 which turns "off" device 129 which effectively disables amplifier 110 so that amplifier 110 no longer controls mode 170. The passive mode circuitry includes a very low current, bias ladder 165 constructed in this embodiment out of 9 series diode connected PFETs (MP1–MP6, MP10–MP12) and one NFET. Series diode connected PFETs are configured so that there is a voltage drop of a certain amount across each FET. The number of PFETs is dependent on the regulation input/output condition and could be determined by a person of ordinary skill in the art knowing the input voltage and the desired output voltage. As an example, for a 5 volt input voltage, and a die operation voltage of 3.3 volts, the following equation can be used to determine the desired output voltage from voltage divider network 165 for passive mode operation:

$$V_{out}=V_{gate}-(V_{TN}+V_{\alpha})$$

where $V_{TN}$=NFET threshold voltage $V_{\alpha}$=body effect voltage.

For an output voltage to be 3.3 volts under very low current conditions ($I_{load}$ is very low), ($V_{TN}+V_{\alpha}$) is approximately 1.2 volts. Hence, if $V_{gate}$=4.5 volts, and if $I_{load}$ is very small (i.e., passive mode conditions), the above equation would be satisfied. Thus, if $V_{gate}$ (denoted by reference numeral 170) is maintained at 4.5 volts, $V_{out}$ will be 3.3 volts. Using Ohm's law (V=IR), the desired drop in source input voltage can be determined for a source voltage of 5 volts. Thus, in FIG. 2, 2 series diode connected PFETs MP1 and MP2 are used to scale voltage 170 to the desired system voltage. This voltage is applied to series pass NFET device 155 to maintain the voltage at the gate of series pass NFET device 155 at the desired passive mode voltage.

FIG. 2 also shows a bypass mode, wherein the active and passive mode circuitry are de-energized, i.e., little or no current flow, and supply voltage 140 is delivered to the source of PFET device 180. PFET device 180 serves to completely bypass the regulation function of the regulator while disconnecting all power to the active and passive circuitry of the regulator. PFET device 180 acts as a small resistor in series with power supply 145.

The multi-mode regulator described above allows the manufacture of CMOS integrated circuits on lower voltage processes for higher voltage applications. Because it is multi-mode, the cost of supplying a regulator or multiple regulators is greatly reduced. Further, the multi-mode operation allows the customer the facility of using the integrated circuit chip as a high voltage part or a lower voltage part as needed in a system. Further, the multi-mode regulator circuit minimizes the variation in the power supply of the device it is used in, thus eliminating the detrimental effects of voltages at the upper end of a range specified for input and increasing the reliability and mean lifetime of integrated circuit devices. The multi-mode voltage regulator can be embedded in a chip and is completely compatible with CMOS circuitry.

Figure 3:
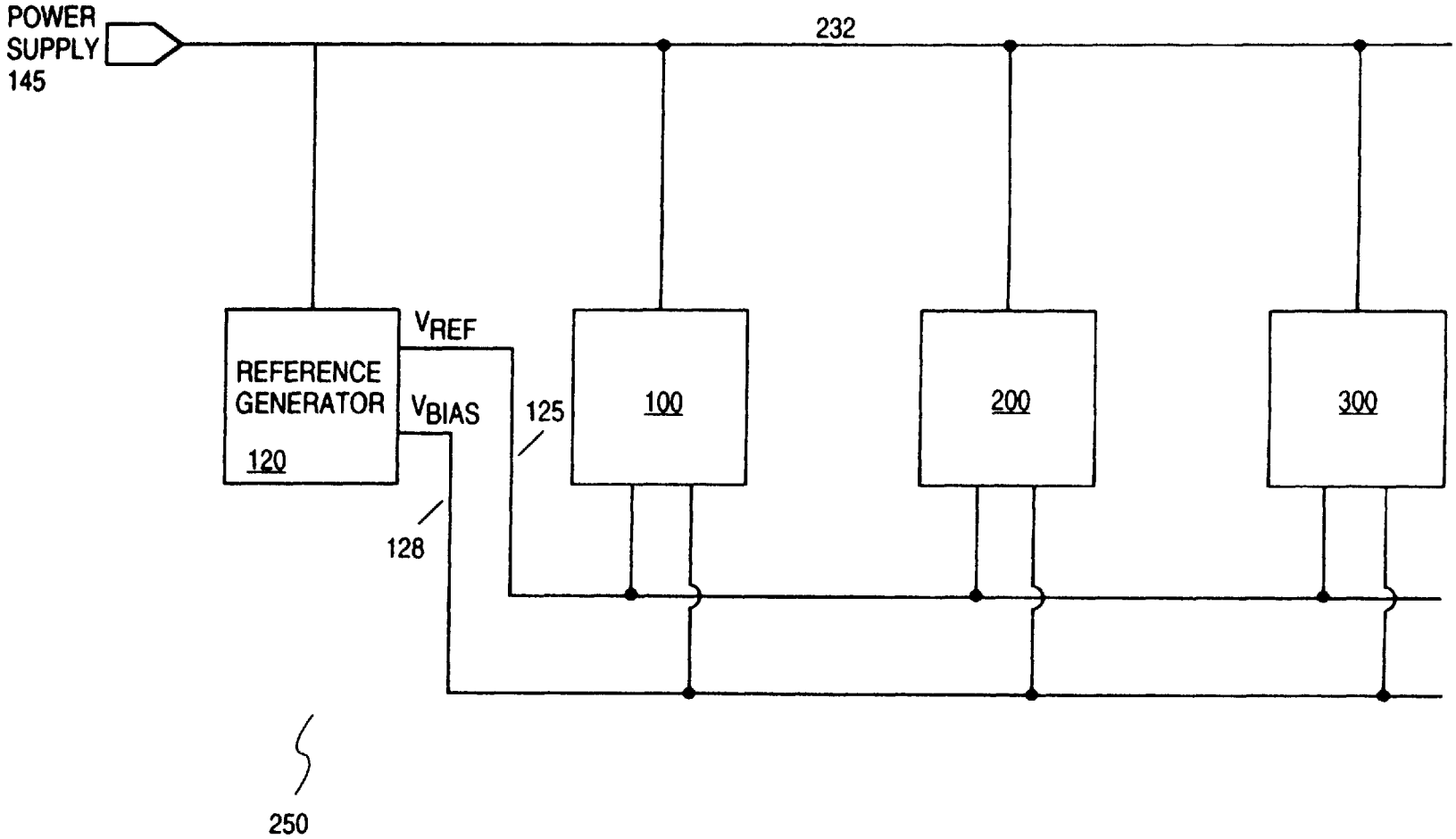
FIG. 3 illustrates three voltage regulator cells coupled to a power bus line on an integrated circuit in accordance with the invention.

FIG. 3 shows a block diagram schematic of a portion of an integrated circuit chip 250 in accordance with another embodiment of the invention. Chip 250 includes a plurality of voltage regulator devices 100, 200, and 300 configured along power bus 232. Configuring an integrated circuit chip 250 with a plurality of voltage regulators allows a consistent power supply to be delivered to different areas of the chip in a manner that minimizes the voltage drop along the power bus structure within the chip and requires significantly smaller on-die capacitance.

Traditional regulator designs use a single large regulator supplying the different units of a chip through a power distribution structure. This approach faces the disadvantage that the supply voltage drops along the power bus line due to voltages drops (i.e., IR drops) along the bus line in the direction of current flow to the individual units. Another disadvantage of such a power distribution scheme is the need for large capacitances to compensate for high current transient loads that occur at different portions of the chip away from the regulator. This is particularly true for large single regulators since the single regulator is slow in response primarily due to its size.

The embodiment of the invention shown in FIG. 3 utilizes the benefit of small, fast, and convenient (in terms of placement or impact to power structures) regulator cells distributed around the chip and working together to maintain the voltage on the power bus nearly the same at all points of the power distribution structure. In FIG. 3, voltage regulator cells 100, 200, and 300, respectively, are each coupled to power bus line 232. Voltage regulator cells 100, 200, and 300, respectively, can be active mode regulators, or multi-mode regulators as described above. In the embodiment shown in FIG. 3, regulator cells 100, 200, and 300, respectively, are each coupled to reference generator 120 for active mode regulation as described above with regard to the multi-mode regulator. The output nodes $V_{OUT}$ of each of the regulators 100, 200, etc. connect in parallel to the internal power supply grids at strategic locations to optimally maintain the grid voltages at the necessary values within the integrated circuit in a manner termed "On-Die Distributed Regulation."

The plurality of voltage regulator circuit configuration maintains near constant supply voltage at all power bus points. The design is fully CMOS implementable and has a very low relative area cost and implementation related re-engineering cost. The design improves load regulation and reduces silicon real estate requirements for regulation. The design also allows for flexibility of use as a 5 volt or a 3.3 volt part, making the chip attractive to customers who are in the process of transitioning from a 5 volt to a 3.3 volt system design. The design is also scalable and can be adapted to chips of larger or smaller current consumption. It can thus be implemented in a broad variety of chips including, but not limited to, microprocessors and micro-controllers.

In the preceding detailed description, the invention is described with reference to specific embodiments thereof. It will, however, be evident that various modifications and changes may be made thereto without departing from the broader spirit and scope of the invention as set forth in the claims. The specification and drawings are, accordingly, to be regarded in an illustrative rather than a restrictive sense.

What is claimed is:

1. An integrated circuit comprising:

a power bus line; and at least two voltage regulator cells formed in a chip and coupled to said power bus line, wherein a load of a first active area of the chip is supplied by a first regulator and a load of a second active area of the chip is supplied by a second regulator.

2. The integrated circuit of claim 1, wherein each of said voltage regulator cells comprises:

a first mode circuit having a gating device and an amplifier, said gating device with a first input for receiving a first voltage and a switch gating output, said amplifier configured to receive a reference voltage and said gating device output as said second voltage, said gating device configured to receive an amplifier output and responsive thereto to couple said first voltage with said gating device output when said gating device output is within a voltage range; and a second mode circuit having a voltage divider with an output, said voltage divider configured to receive said first voltage and supply a second voltage to said voltage divider output.

3. The integrated circuit of claim 2, said gating device of each of said voltage regulator cells is a first gating device and wherein each of said voltage regulator cells further comprises a third mode circuit having a second gating device with an output, said second gating device configured to receive said first voltage and responsive thereto to couple said first voltage with said second gating device output.

4. The integrated circuit of claim 1, wherein the voltage regulators are coupled in parallel to the power bus line.

* * * * *

UNITED STATES PATENT AND TRADEMARK OFFICE

CERTIFICATE OF CORRECTION

PATENT NO. : 6,081,105
DATED : June 27, 2000
INVENTOR(S) : Nair

It is certified that error appears in the above-identified patent and that said Letters Patent is hereby corrected as shown below:

Column 1,
Line 143, delete "cr" and insert -- or --.

Column 3,
Line 19, delete "serves" and insert -- series --.

Signed and Sealed this

Sixth Day of November, 2001

*Attest:*

Nicholas P. Godici

NICHOLAS P. GODICI
*Acting Director of the United States Patent and Trademark Office*

*Attesting Officer*